US008981261B1

(12) United States Patent
Tillotson

(10) Patent No.: US 8,981,261 B1
(45) Date of Patent: Mar. 17, 2015

(54) METHOD AND SYSTEM FOR SHOCKWAVE ATTENUATION VIA ELECTROMAGNETIC ARC

(75) Inventor: Brian J. Tillotson, Kent, WA (US)

(73) Assignee: The Boeing Company, Chicago, IL (US)

( * ) Notice: Subject to any disclaimer, the term of this patent is extended or adjusted under 35 U.S.C. 154(b) by 336 days.

(21) Appl. No.: 13/483,995

(22) Filed: May 30, 2012

(51) Int. Cl.
*F42D 5/045* (2006.01)
*F41H 5/007* (2006.01)

(52) U.S. Cl.
USPC ..... 219/383; 219/201; 219/202; 89/36.01; 89/36.07; 89/36.08; 89/36.09

(58) Field of Classification Search
None
See application file for complete search history.

(56) References Cited

U.S. PATENT DOCUMENTS

| | | | | |
|---|---|---|---|---|
| 1,195,042 | A | 8/1916 | Leon | |
| 2,405,694 | A | 8/1946 | Nicolas | |
| 2,513,279 | A | 7/1950 | Albert | |
| 3,050,707 | A | 8/1962 | Baker et al. | |
| 3,660,951 | A | 5/1972 | Cadwell | |
| 3,773,168 | A | 11/1973 | Meinass | |
| 3,875,844 | A | 4/1975 | Hicks | |
| 3,943,870 | A | 3/1976 | Paslay | |
| 4,215,630 | A | 8/1980 | Hagelberg et al. | |
| 4,313,181 | A | 1/1982 | Holm | |
| 4,543,872 | A | 10/1985 | Graham et al. | |
| 5,020,411 | A * | 6/1991 | Rowan | 89/1.11 |
| H1231 | H | 9/1993 | Richards | |
| 5,341,718 | A | 8/1994 | Woodall et al. | |
| 5,394,786 | A | 3/1995 | Gettle et al. | |
| 5,400,688 | A | 3/1995 | Eninger et al. | |
| 5,739,458 | A | 4/1998 | Girard | |
| 6,029,558 | A | 2/2000 | Stevens et al. | |
| 6,256,263 | B1 | 7/2001 | Stevens | |
| 6,266,926 | B1 | 7/2001 | Figge et al. | |
| 6,279,449 | B1 | 8/2001 | Ladika et al. | |
| 6,412,391 | B1 | 7/2002 | Stevens et al. | |
| 6,595,102 | B2 | 7/2003 | Stevens et al. | |
| 6,653,972 | B1 | 11/2003 | Krikorian et al. | |
| 6,782,790 | B2 * | 8/2004 | Barrett | 89/1.11 |

(Continued)

FOREIGN PATENT DOCUMENTS

| | | |
|---|---|---|
| WO | 97/16697 | 5/1997 |
| WO | 2011/148165 | 12/2011 |

OTHER PUBLICATIONS

"Review of methods to attenuate Shock/Blast waves," Igra et al, Dec. 2012.*

*Primary Examiner* — Joseph M Pelham
(74) *Attorney, Agent, or Firm* — Thompson Hine LLP

(57) ABSTRACT

A method and system for attenuating a shockwave propagating through a first medium by heating a selected region of the first fluid medium rapidly to create a second, transient medium that intercepts the shockwave and attenuates its energy density before it reaches a protected asset. The second medium may attenuate the shockwave by one or more of reflection, refraction, dispersion, absorption and momentum transfer. The method and system may include a sensor for detecting a shockwave-producing event, determining a direction and distance of the shockwave relative to a defended target and calculating a firing plan, and an arc generator for creating the second medium. The arc generator may create the second medium by creating an electric arc that travels along an electrically conductive path utilizing at least one of high intensity laser pulses, pellets forming a conductive ion trail, sacrificial conductors, projectiles trailing electrical wires, and magnetic induction.

23 Claims, 7 Drawing Sheets

(56) References Cited

U.S. PATENT DOCUMENTS

| | | | | |
|---|---|---|---|---|
| 7,077,049 | B2 | 7/2006 | Shumov et al. | |
| 7,213,494 | B2 | 5/2007 | James | |
| 7,350,447 | B1 * | 4/2008 | Smith | 89/1.13 |
| 7,421,936 | B2 | 9/2008 | Barger et al. | |
| 7,437,987 | B1 | 10/2008 | Ohnstad et al. | |
| 7,827,900 | B2 | 11/2010 | Beach et al. | |
| 7,866,250 | B2 | 1/2011 | Farinella et al. | |
| 7,878,103 | B2 | 2/2011 | Imholt et al. | |
| 8,042,449 | B2 | 10/2011 | Farinella et al. | |
| 8,051,762 | B2 | 11/2011 | Beach et al. | |
| 8,141,470 | B1 | 3/2012 | Farinella et al. | |
| 8,151,710 | B2 | 4/2012 | Fu et al. | |
| 8,436,730 | B2 | 5/2013 | Fischbach et al. | |
| 8,437,223 | B2 | 5/2013 | Barger et al. | |
| 8,448,559 | B2 | 5/2013 | Hunn et al. | |
| 8,555,768 | B1 | 10/2013 | Barker et al. | |
| 8,863,666 | B2 * | 10/2014 | Tillotson et al. | 102/215 |
| 2003/0233931 | A1 * | 12/2003 | Nemtsev | 89/1.11 |
| 2004/0107827 | A1 | 6/2004 | Edberg et al. | |
| 2004/0118270 | A1 * | 6/2004 | Barrett | 89/1.11 |
| 2007/0006723 | A1 | 1/2007 | Waddell, Jr. et al. | |
| 2007/0180983 | A1 | 8/2007 | Farinella et al. | |
| 2008/0190276 | A1 | 8/2008 | Barger et al. | |
| 2009/0114084 | A1 | 5/2009 | Thinn et al. | |
| 2009/0266226 | A1 | 10/2009 | Beach et al. | |
| 2010/0319524 | A1 | 12/2010 | Farinella et al. | |
| 2010/0319526 | A1 | 12/2010 | Imholt et al. | |
| 2011/0120294 | A1 | 5/2011 | Beach et al. | |
| 2011/0168004 | A1 | 7/2011 | Henegar | |
| 2011/0297031 | A1 | 12/2011 | Fu et al. | |
| 2012/0060677 | A1 | 3/2012 | Farinella | |

* cited by examiner

Prior to Shock Interaction

After Shock Interaction

Prior to Shock Interaction

After Shock Interaction

METHOD AND SYSTEM FOR SHOCKWAVE ATTENUATION VIA ELECTROMAGNETIC ARC

FIELD

The disclosure relates to methods and systems for shockwave attenuation, and more particularly to methods and systems for attenuating shockwaves by rapidly heating air to interpose an intermediate medium between the shockwave and a protected region.

BACKGROUND

Explosive devices are being used increasingly in asymmetric warfare to cause damage and destruction to equipment and loss of life. The majority of the damage caused by explosive devices results from shrapnel and shockwaves. Shrapnel is material, such as metal fragments, that is propelled rapidly away from the blast zone and may damage stationary structures, vehicles, or other targets. Damage from shrapnel may be prevented by, for example, physical barriers. Shockwaves are traveling discontinuities in pressure, temperature, density, and other physical qualities through a medium, such as the ambient atmosphere. Shockwave damage is more difficult to prevent because shockwaves can traverse an intermediate medium, including physical barriers.

Damage from shockwaves may be lessened or prevented by interposing an attenuating material between the shockwave source and the object to be protected. This attenuating material typically may be designed or selected to absorb the energy from the shockwave by utilizing a porous material that distorts as the energy of the shockwave is absorbed.

U.S. Pat. No. 5,394,786 to Gettle et al. describes a shockwave attenuation device that utilizes an absorbing medium. That assembly includes porous screens that form an enclosure filled with a pressure wave attenuating medium. This attenuating medium may be an aqueous foam, gas emulsion, gel, or granular or other solid particles. However, as shown and described in the drawings of that patent, the shockwave attenuating assembly must be positioned before the explosion occurs and surround the area to be protected. For example, the assembly may be positioned on the side of a vehicle to prevent damage to the vehicle or passengers within.

A similar shockwave attenuation device is described in U.S. Patent Publication No. 2007-0006723 to Waddell, Jr. et al. That device includes a number of cells filled with an attenuating material, such as aqueous foams. However, like the device described in Gettle et al., the pressure-attenuating material and device must be positioned on a structure, surface, or person desired to be protected by the system before the explosion occurs.

One feature common among prior art shockwave attenuation systems is that they require an intermediate medium or structure that acts to attenuate the force of the shockwave by absorbing the energy of the shockwave. Although only a portion of the shockwave may pass through the medium, the energy of the shockwave is nevertheless significantly reduced by the intermediate medium. However, because these systems are structural, they must be fixed in place before a shockwave is created. Further, these shockwave attenuation systems may not protect an entire vehicle or person. For example, attenuating panels are not transparent and therefore cannot be placed over windows or used as facemasks in helmets. They also may be bulky and heavy, and therefore negatively impact the performance of a vehicle on which they are mounted.

Such prior art shockwave attenuation systems may not be effective to protect highly mobile land assets for which an incoming threat may be in the form of a ballistic shell, rocket, IED, or landmine, or waterborne assets for which an incoming threat may be in the form of a torpedo, ballistic shell, bomb or a naval mine. Therefore, a need exists for a shockwave attenuation device that is capable of dynamically interposing a medium between an explosion source and a protected asset. There is also a need for an intermediate medium that effectively attenuates the energy from a shockwave and that allows for protection of a protected asset in a marine environment.

SUMMARY

Presented is a system and method for attenuating a shockwave propagating in a first medium by detecting a shockwave-producing event, determining a direction of the shockwave relative to a protected asset, and interposing a second, transient medium, different from the first medium, between the shockwave and the protected asset such that a shockwave produced by the event contacts the second medium and is attenuated in energy thereby prior to reaching the protected asset. The second medium may be formed by rapidly heating a region of the first medium so that the second medium differs from the first medium in at least one of temperature, density and composition.

In one embodiment, a system for attenuating a shockwave propagating in a first medium may include a sensor for detecting a source of the shockwave and generating a detection signal, an arc generator in communication with the sensor and configured to receive the detection signal therefrom, and in response thereto create an electromagnetic arc to heat a selected region of the first fluid medium rapidly to create the second, transient medium, different from the first medium, interposed between the shockwave and the protected region such that the shockwave contacts the second, transient medium. The arc generator may be configured to heat the selected region by generating an electromagnetic arc, such as an electric arc or a laser or microwave arc, between the protected region and the incoming shockwave. In one embodiment, the arc generator may include a power supply for generating the arc and may provide a conducting path.

In embodiments, the arc generator may be configured to generate a focused microwave beam or a focused laser beam. In each case, the beam may rapidly heat the fluid medium in the selected region to create the second medium. In one embodiment, in which the fluid medium is atmospheric air, the focused beam rapidly heats the air in the selected region and changes its temperature, density and composition, the latter the result of the creation of free electrons.

In other embodiments, the arc generator may be adapted to develop and drive a large electric current through the fluid medium rapidly. In the embodiment in which the medium is atmospheric air, the second medium may differ from ambient air in temperature, density and composition. With these embodiments, the arc generator may be adapted to create a conducting path for the electric current. Accordingly, the arc generator may be configured to generate one or more of a laser-induced plasma channel (LIPC) from converging laser beams, ionizing tracer pellets fired along converging paths, and projectiles trailing fine electrical wires fired along converging paths. In each of these embodiments, an electric arc may be generated to travel along a conducting path created by dielectric breakdown of ionized ambient air at the selected region.

In still other embodiments, the arc generator may include a sacrificial conductor that may not rely on current travel along a path of ionized air. Rather, the arc generator may include a power supply that applies current to a conductor in the form of one or more strips or wires of conductive material. The high current flowing through the conductor from the power supply may vaporize the conductor, forming a conductive channel of vapor that may rapidly heat and ionize the air in the selected region to create a rapidly expanding second medium. An advantage of this embodiment is that the sacrificial conductor may be attached directly to the protected asset, such as a vehicle.

Such embodiments as described above may reduce the energy density of the shockwave by creating a second medium in the path of the advancing shockwave that reflects, refracts, absorbs and deflects at least a portion of the shockwave. This may result from creating a second medium that differs from the ambient medium (e.g., atmospheric air) in density, temperature and/or composition. Such differences may change the index of refraction of the wave front as it contacts the second medium, causing at least some of the shockwave to be reflected from the surface of the second medium, to diverge as the shockwave travels through the medium, and to be reflected and diverge further as the shockwave contacts the rearward boundary of the second medium. The second medium, some embodiments, acts to absorb the energy of the shockwave as the medium may be increased in temperature.

In yet other embodiments, the arc generator create the second medium by magnetic induction. The arc generator may be adapted to create channels or ionized air. When contacted by an advancing shockwave, the conducting channel may be deformed as ionized air is pushed inward. This movement does mechanical work, which removes energy from the shockwave, making it weaker. In one aspect, the channels may not be rigid, and may be pushed by the shockwave against the ambient air that the channels are displacing, which may transfer energy from the shockwave to kinetic energy of displaced air. In another aspect, parts of the conductive channels are not rigid, but the channels of ionized air pushed ahead of the magnetic flux are disrupted and broken until they form new channels through the air that heat the air. At least a portion of the shockwave energy may be transformed to ionization energy of air ions and into pressure-volume-temperature energy of expanded hot air.

In still another aspect, the conductive channels of magnetic flux are rigid may not be deformed by contact with the advancing shockwave. Instead, the flux may be compressed by contact with the shockwave, which may increase the electric current in the conductive channels. This increased current results from energy lost by the shockwave. The arc generator may be configured such that the excess current may bypass the power supply and be shunted to heat a resistive load, or charge a capacitor where it may be used later to power the arc generator.

With such embodiments, the advancing shockwave is diminished in force as the energy of the shockwave is converted either into mechanical energy, as when it deforms magnetic induction channels, or into electrical energy, as when it interacts with rigid magnetic flux channels. It is within the scope of this disclosure to provide a system and method in which combinations of the foregoing embodiments are deployed to defend a protected asset, or in which an embodiment is deployed multiple times against an incoming threat.

The features, functions, and advantages that have been discussed can be achieved independently in various embodiments of the present invention or may be combined in yet other embodiments further details of which can be seen with reference to the following description, drawings and claims.

DETAILED DESCRIPTION

The disclosed shockwave attenuation method and system may utilize a second, transient fluid medium that may be dynamically deployed in a first fluid medium between an explosion and a protected asset within a protected region. When contacted by an advancing shockwave produced by the explosion traveling through the first fluid medium, the second fluid medium may attenuate the energy from the shockwave through several vectors, rather than simply by absorbing the energy of the shockwave. While the following discussion describes various embodiments of the disclosed system and method as operating in a first fluid medium of atmospheric air, it is to be understood that the first fluid medium may be water, such that the disclosed system and method may be deployed in a marine environment.

Figure 1:
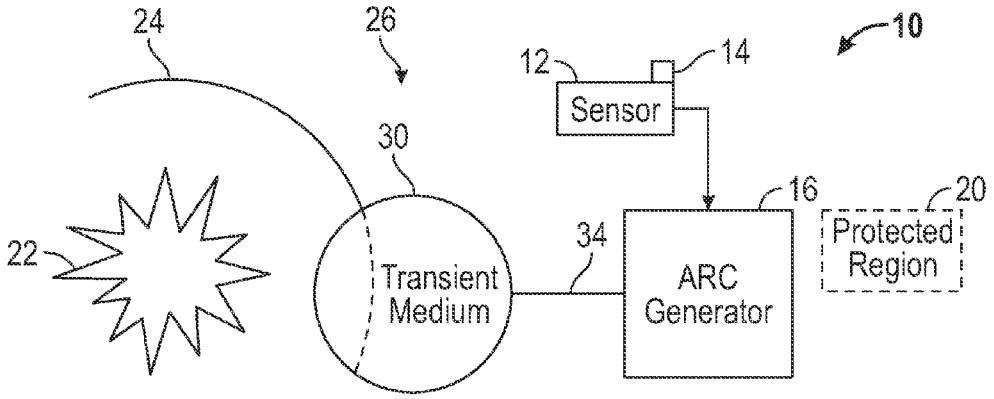
FIG. 1 is a schematic diagram of the elements of a disclosed system, according to an embodiment.
Figure 2:
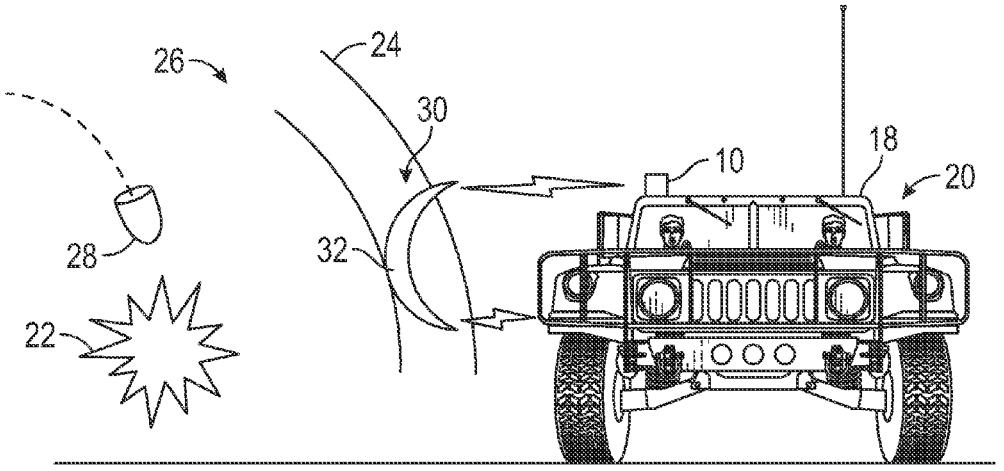
FIG. 2 is an elevational, schematic view of the disclosed system mounted on a protected asset generating an arc to encounter a shockwave from an explosion.

As shown in FIG. 1, in one embodiment, the system for attenuating a shockwave via electromagnetic arc, generally designated 10, may include a sensor 12 including or incorporating a computer 14, and an arc generator, generally designated 16. The sensor 12 and computer 14 may be mounted on or incorporated in a protected asset, such as a vehicle 18, which may be a military vehicle as shown in FIG. 2, or they may be physically separate from the vehicle. Although FIG. 2 shows vehicle 18 as a military vehicle, it is to be understood that the depicted vehicle 18 also may represent other types of land vehicles, such as automobiles, armored vehicles such as tanks and armored personnel carriers; fixed structures such as encampments, bunkers, revetments, buildings or portions of buildings such as balconies; marine vessels such as surface ships, submarines, a hovercraft or air-cushion vehicles, offshore platforms, and other structures that operate in, under or adjacent a body of water; aircraft including fixed wing aircraft, vertical takeoff and landing (VTOL) craft and helicopters; and people and animals. Each of the foregoing would be placed in a protected region 20.

Referring to FIG. 1, the sensor 12 may be selected to provide measurements that enable the computer 14 to estimate the location and time of an explosion 22, either before or after it occurs, and direct the arc generator 16 to respond. In one embodiment, the sensor 12 is configured to detect an explosion 22 that has occurred, but before the shockwave 24 caused by the explosion, traveling through a first fluid medium 26, which in this embodiment is atmospheric air at ambient temperature and pressure, reaches the protected region 20. This type of sensor 12 may be configured to detect any one or more of the electromagnetic signals emitted during chemical detonations, including microwave bursts, flashes of infrared radiation, flashes of visible light, flashes of ultraviolet light, and x-ray bursts. In an embodiment a sensor 12 may be configured to detect two or more of the foregoing types of electromagnetic radiation, which may result in the sensor detecting fewer false positives. In a variation of such an embodiment, the sensor 12 may be in the form of two discrete sensors, each configured to detect a different type of electromagnetic radiation. In an embodiment in which the sensor 12 is selected for use in a marine environment (e.g., to detect underwater explosions from naval mines or torpedoes), the sensor 12 may be configured to detect electromagnetic radiation at wavelengths for which water is substantially transparent, such as visible light near-ultraviolet light and near-infrared light.

In some embodiments, once the sensor 12 has detected an explosion 22, the sensor may be configured to estimate one or more of the magnitude, distance, and azimuthal position of the explosion and provide the estimates to the computer 14 or to the arc generator 16. In some embodiments, the computer 14 may measure the signature of the explosion 22 and compare it with stored known explosion signatures of a plurality of different known explosive devices. The computer 14 may then determine a probability that the explosion is from one of the known explosive devices. The computer 14 may then calculate an estimated probability distribution function (p.d.f.) of explosion magnitudes and locations relative to the protected asset 18 or protected region 20 based on at least one of stored data about the type of explosive device, location of the explosion, and the shape, relative orientation and relative motion of the protected asset, and make a determination to counter the explosion 22, including determining when and where to activate the arc generator 16, or not counter the explosion, based on one of stored data, models of vulnerability of the protected asset to shockwaves, and data from at least one of data and models of performance of the arc generator 16 with respect to attenuating shockwaves from at least one of an estimated explosion magnitude and location. Such calculations and estimates may prevent the deployment of the arc generator 16 in the event that the explosion 22 is too far away or too weak to generate a shockwave 24 that damages the protected region 20 significantly.

In another embodiment, the sensor 12 may be configured to detect an incoming threat 28 containing an explosive device or devices, such as a ballistic shell, bomb, torpedo, depth charge, naval mine or bomb-laden surface vessel. In such an embodiment, the sensor 12 may be configured to use radar, visible or infrared light, passive or active acoustic sensors, or other threat-detection method known to those skilled in the art, as well as trajectory tracking and prediction methods known to those skilled in the art.

In yet another embodiment, the sensor 12 may be configured to detect both the incoming threat 28 and the explosion 22 from the threat. In one embodiment, two systems 10 may be deployed on a protected asset 18 in which one system is configured to detect an incoming threat 28 and the other system is configured to detect an explosion 22. In yet another variation of such an embodiment, the sensor 12 may be in the form of two discrete sensors: one configured to detect an incoming threat 28, and the other configured to detect an explosion 22 from that incoming threat.

In some embodiments, the computer 14 may receive measurements from the sensor 12, estimate where and when an incoming threat 28 will detonate, or has already detonated, and directs the system 10 to deploy. When used with a sensor 12 that may detect an explosion that already has occurred, the computer 14 may be configured to receive information from the sensor pertaining to one or more of the direction, location, time, distance and magnitude of the explosion 22, the computer determines when and where to activate the arc generator 16.

In an embodiment wherein the sensor 12 is configured to detect an incoming threat 28 before explosion 22 has occurred, the computer 14 may be configured to compare the signature of the incoming threat 28 with stored known signatures of various threats (e.g., particular missiles). The computer 14 then estimates how probable each type of threat is, and, based on the stored data about the type of warhead for each threat, the measured motion of the incoming object (with associated uncertainty), and the shape, trajectory, orientation, speed and motion of the protected asset 18 in the protected region 20, the computer estimates a probability distribution function (p.d.f.) of explosion magnitudes and locations relative to the protected asset.

Based on data or models of vulnerability of the protected asset 18 to shockwaves 24 of various magnitudes from various directions (including crew injuries likely to result from shockwaves) stored in a database (either locally or available over a network), together with data or models of what the arc generator 16 can do to attenuate shockwaves in what positions and in what time interval, the computer 14 may then form a firing plan to counter the threat at minimum cost. Cost may include not only the cost to operate the arc generator 16, but also the probable cost of damage from the attenuated shockwave. In cases where the probable explosion yield is small and the probable distance of the explosion 22 from the protected region is large, the lowest cost plan may be not to deploy the system 10.

As shown in the embodiments of FIGS. 1 and 2, the arc generator 16 may be configured to create a transient second medium 30 between the advancing shockwave 24 resulting from the explosion 22 and the protected region 20, which may contain a protected asset 18. As shown in FIG. 2, generally speaking, the sensor 12 may generate a detection signal in response to detecting at least one of the explosion 22 or explosive device such as incoming threat 28. The detection signal is received by arc generator 16, and in response, may create an electromagnetic arc through the first medium 26 which rapidly heats the medium to change one or more of its composition and temperature to create the second, transient medium 30, different from the first medium 26. The location of the second medium 30 may be in a selected region calculated by the computer 14 of the sensor 12 to be interposed between the shockwave 24, or predicted shockwave path, and the protected region 20. Thus, the shockwave 24 contacts the second, transient medium 30 and is attenuated in energy density before it reaches the protected region 20. The arc generator 16 shown schematically in FIG. 1 may take the form of multiple, discrete arc generators, each connected to and controlled by the sensor 12.

In one embodiment, shown schematically in FIG. 1, the arc generator 16 is configured to direct a beam 34 of electromagnetic energy to focus in a selected region where the second medium 30 may be created. The beam 34 may be in the form of a relatively powerful microwave beam or laser beam. The electric field of the intense beams 34 may cause dielectric breakdown of the ambient air at the focal point of the focused beams, in which the electrons are separated from the molecules in the air. The free electrons are accelerated by the electric field and strike other molecules to knock other electrons loose, creating a cascade of electrons and ions.

As the density of free charge carriers in the air increases, the air becomes opaque to the incoming electromagnetic beams and rapidly absorbs energy from the beams as heat, which raises the temperature of the air as well as its density and composition, thus creating the second medium 30 to intercept the advancing shockwave 24. The composition changes of the second fluid medium 30 may include adding free electrons, which have a relatively low molar mass, ionization of molecules so that they interact more strongly and therefore propagate shockwaves at higher speeds, and breaking diatomic molecules such as molecular oxygen into single atoms, which reduces the average molar mass.

In some embodiments, the beam 34 may be a microwave beam. The arc generator 16 may include a vacuum tube amplifier (e.g., a magnetron) and focused by a static focusing device (e.g., a dish antenna or a Fresnel plate), or produced and focused by other means of combinations apparent to those skilled in the art. In other embodiments, the beam 34 is a laser beam. The laser beam may be a single beam focused to a point by optics, or multiple beams converging to a common point. In either case, the beam 34 may create single or multiple arcs 32 (FIG. 2). In some embodiments, the arc generator 16 may use many converging beams 34 to create one arc 32. In other embodiments one beam 34 may be used multiple times in quick succession to create many arcs 32. The beams may be fixed or steerable.

Figure 3:
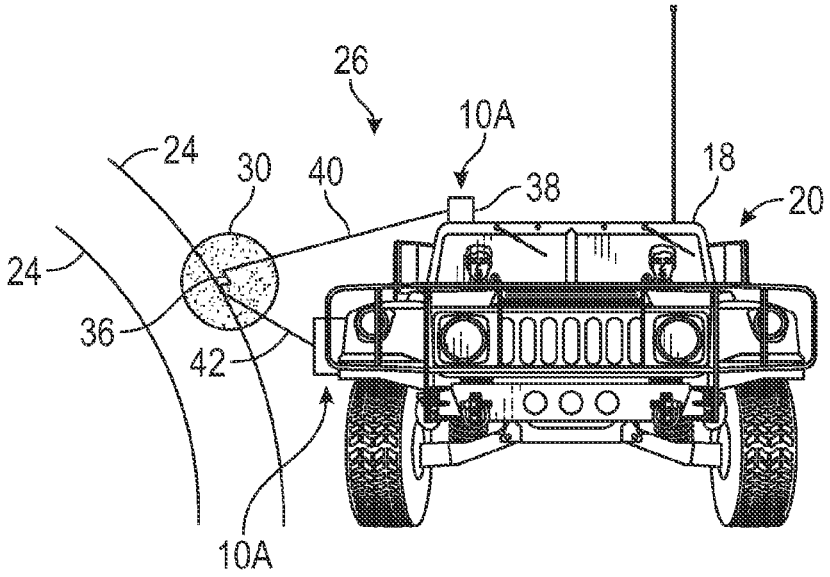
FIG. 3 is an elevational, schematic view of the disclosed system configured to utilize converging laser or microwave beams.

As shown in FIG. 3, in another embodiment of the system 10A the arc generator 16 (FIG. 1) may be configured to generate an electric arc 36 through a volume of ambient air 26 to create the second medium 30. Electrical resistance to the current heats the air, changing its temperature, density and composition to create the second medium 30 to attenuate the shockwave 24. The change in composition may include adding free electrons, which have very low molar mass, ionization of molecules so they interact at longer distance and therefore propagate shockwaves at higher speed, and breaking diatomic molecules like oxygen into single atoms, which reduces the average molar mass of the fluid in the second medium 30.

The arc generator 16 (FIG. 1) of the system 10A of this embodiment may include a power supply 38 configured to initiate a large electric current quickly—typically on the order of a few milliseconds or less. Such a power supply 38 may include a capacitor, a superconducting storage coil, and an explosive flux compression generator. The first two examples may require fast-acting, high-current switchgear, such as a gas-insulated switch, to turn on a large current quickly (for the capacitor) or to divert it quickly from a shunt to the electric arc (for the storage coil).

In one aspect of this embodiment, the arc generator 16 creates an electrically conductive path from the power supply 38 to the selected region between the shockwave 24 and the protected region 20 to establish the arc, and back to the power supply. In one embodiment, shown in FIG. 3, the arc generator 16 creates a laser-induced plasma channel (LIPC). The arc generator 16 fires two high-intensity laser beams 40, 42 along converging paths. The laser wavelengths and intensities are selected to ionize the air along their paths, thereby forming the plasma channels. The power supply 38 applies voltage across the terminals at the bases of the two channels 40, 42, and the voltage is sufficient to form the arc 36 through the air 26 where the beams are close to each other. Current flows through the channels of the LIPC and induces a magnetic field. The current interacts with the magnetic field and produces an outward force (J×B). This force acts to widen the area enclosed by the current loop.

Figure 4:
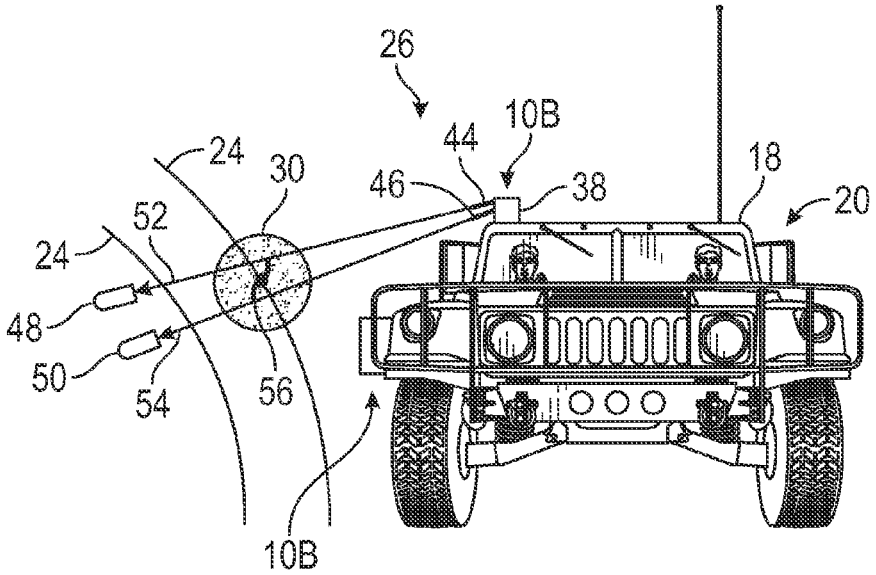
FIG. 4 is an elevational, schematic view of the disclosed system configured to utilize pellets leaving conductive trails.

As shown in FIG. 4, in another embodiment of the system 10B the arc generator 16 (FIG. 1) is a gun, which may have at least two or multiple barrels 44, 46 that fire two pellets 48, 50 along converging paths. The pellets 48, 50 are configured to create trails 52, 54 of ions, for example, by burning silver iodide, in the manner of tracer bullets. The two trails 52, 54 form conductive channels through the air (the first fluid medium), and the power supply 38 applies voltage across terminals at the bases of the two conductive channels, preferably the barrels 44, 46. The voltage is sufficient to form an arc 56 through the air 26 between the two trails 52, 54 (i.e., the conductive channels) where they are at their closest. The arc 56 heats the air 26 to create the second transient fluid medium 30. In other embodiments, the pellets 48, 50 may be selected to melt or burn up completely, thereby avoiding creating a hazard for by standers.

Figure 5:
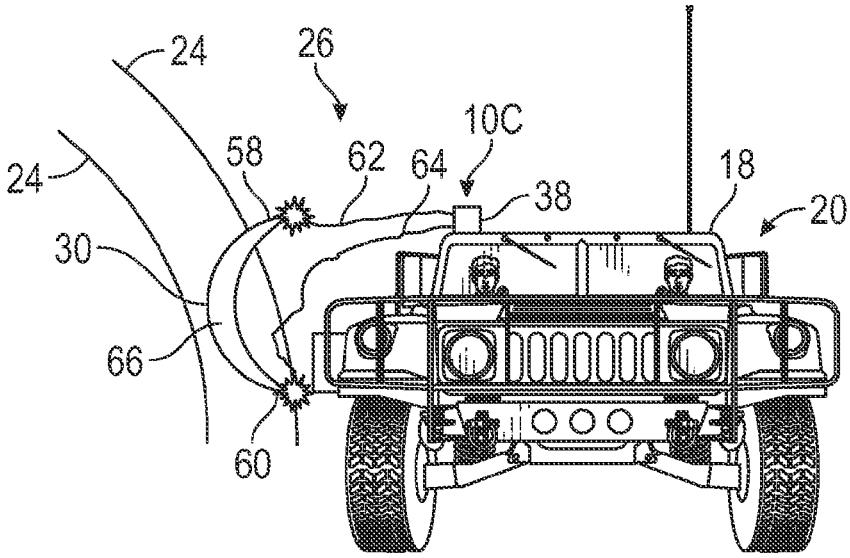
FIG. 5 is an elevational, schematic view of the disclosed system configured to utilize projectiles trailing conductive wires.

As shown in FIG. 5, in another embodiment of the system 10C the arc generator 16 (FIG. 1) is a projectile launcher configured to launch projectiles 58, 60 trailing conductive wires 62, 64 much like a Taser®. The power supply 38 applies voltage across the two wires sufficient to form an arc 66 through the air 26 where the paths of the projectiles 58, 60 are closest to each other. The arc 66 heats the air 26, forming the second fluid medium 30 in a selected region between the advancing shockwave 24 and the protected asset 18 in the protected region 20. As electrical current flows through the wires 62, 64, which form conductive channels, the current further heats and ionizes the air 26. In some embodiments, the current is sufficient to vaporize the wires 62, 64, thereby heating additional nearby air 26.

Figure 6:
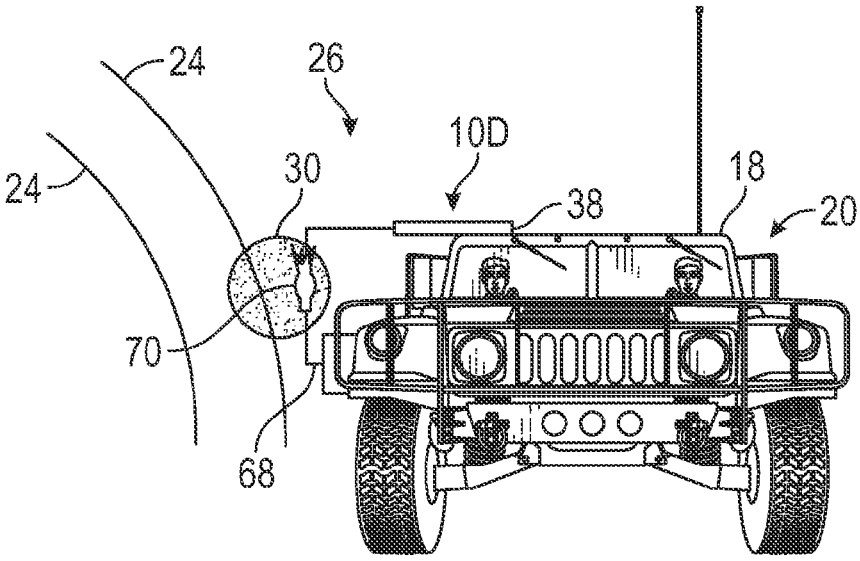
FIG. 6 is an elevational, schematic view of the disclosed system configured to utilize a sacrificial conductor.
Figure 7:
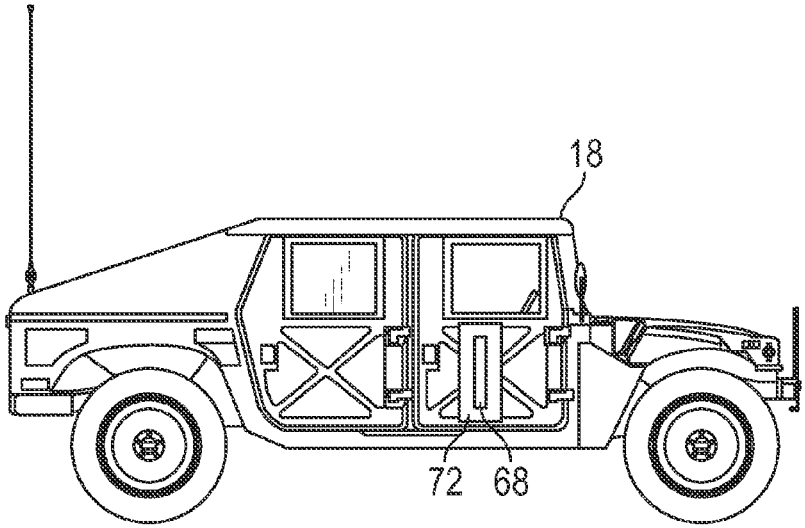
FIG. 7 is an elevational, schematic view of the system of FIG. 6 surface mounted on a protected asset.

As shown in FIGS. 6 and 7, in another embodiment the system 10D includes a arc generator 16 (FIG. 1) in the form of one or more sacrificial conductors 68 connected to the power supply 38. The heating mechanism of this embodiment does not rely on dielectric breakdown of the air 26 to create a current channel. The sacrificial conductor 68 may be in the form of strips or wires made of electrically conductive material. In some embodiments, the conductor 68 may be mounted on the protected asset 18.

To deploy the system 10D, the arc generator 16 actuates the power supply 38 to supply current to one of more of the conductors 68, first vaporizing it, then ionizing it to form a conductive channel of vapor 70. Due to both the resultant magnetic field (J×B) force and the expansion of the hot vapor created by vaporizing the conductor, the ionized vapor moves outward from its initial position and heats and ionizes the nearby air to create the second fluid medium 30.

In one embodiment, shown in FIG. 7, the sacrificial conductor 68 may be attached to a protected asset 18, which may be the land vehicle shown. The conductor 68 may be attached to a wider insulating strip 72 that in turn is mounted on the asset 18. With such a placement of the conductor 68, the conductor 68 may be protected from routine vehicle operations, and may be further protected by overlaying it with a coat of paint. When energized by the power supply 38 (FIG. 6), the conductor 68, which may be a metallic strip, vaporizes, and the heated and ionized air may expand from the vehicle surface and move away from the vehicle to create the second medium 30 in the selected region.

In yet another embodiment, the sacrificial conductor 68 may be made partly or entirely of lithium. Lithium has a very low molecular weight, and consequently a higher shock speed and lower effective index of refraction than other metallic vapors. Further, it disperses into nearby air 26 more quickly, which helps to heat the air more rapidly.

Figure 8A:
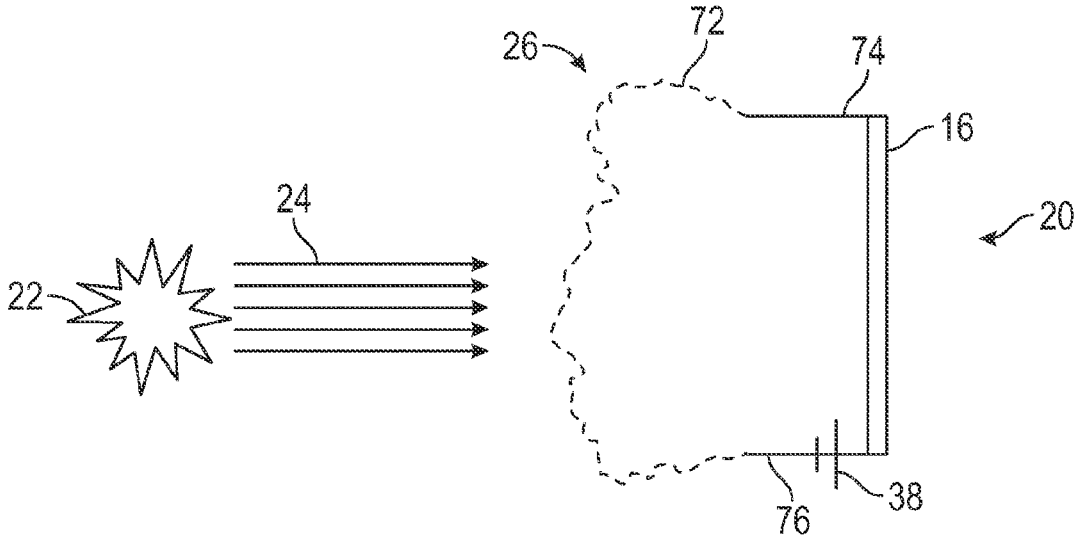
FIGS. 8A and 8B are schematic views of an embodiment of the heating element of the disclosed system configured to generate an arc using flexible electrodes.

In other embodiments, the arc generator 16 may be configured to attenuate the advancing shockwave by magnetic induction. As shown in FIG. 8A, the arc generator 16 may be powered by the power supply 38 to create an electric arc 72 that forms a conducting channel between two electrodes 74, 76 that are not rigid, such as thin rod antennae. The conducting channel 72 interacts with its own magnetic field to produce an outward force $F=J\times B$ (where F is the outward force, J is the current density and B is the magnetic field flux).

Figure 8B:
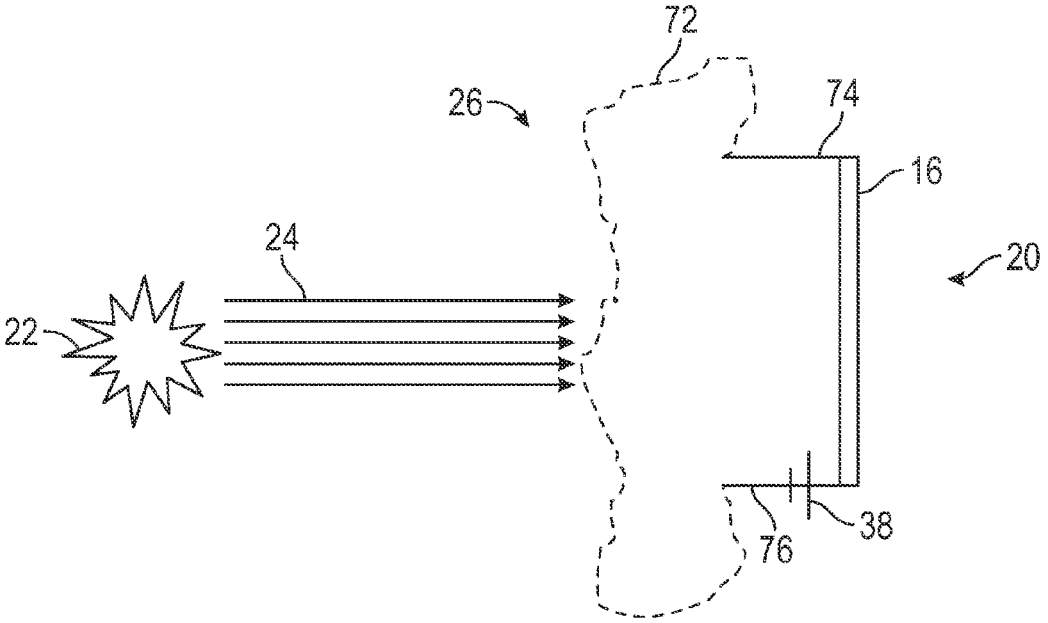

When the shockwave 24 created by an explosion 22 reaches the arc 72, as shown in FIG. 8B, the shockwave deforms the arc in directions perpendicular to the conductive channels. Specifically, the shockwave 24 pushes the ionized air created by or making up the arc 72 inward, and the current tends to flow where the air 26 is ionized. This movement by the shockwave 24 may do mechanical work against the magnetic field force F and remove energy from the shockwave, making it weaker. Although not shown, the movement by the shockwave 24 also may deform the electrodes 74, 76, which also represents physical work that drains energy from the shockwave 24.

In the embodiment shown in FIGS. 8A and 8B, because the electrodes 74, 76 may be relatively non-rigid, these parts and the conductive channel 72 push against the air 26 they are displacing. This may transform energy from the shockwave 25 into kinetic energy of displaced air. In some cases it may be possible for the conductive channels 72 and electrodes 74, 76 to push the air so fast that they may create new shockwaves moving away from the protected region 20.

In a variation, the parts of the conductive channels 72 and electrodes 74, 76 may not be rigid, but the channels of ionized air pushed ahead of the magnetic flux are disrupted (broken) when they flow rapidly through the air 26. Each time a channel 72 breaks, the electric current briefly stops. When it stops, the trapped magnetic flux creates an electromotive force strong enough to ionize a new channel through the air 26 and then heat that air. This may transform energy from the shockwave 24 into ionization energy of air ions and into pressure-volume-temperature energy of expanded hot air.

Figure 9A:
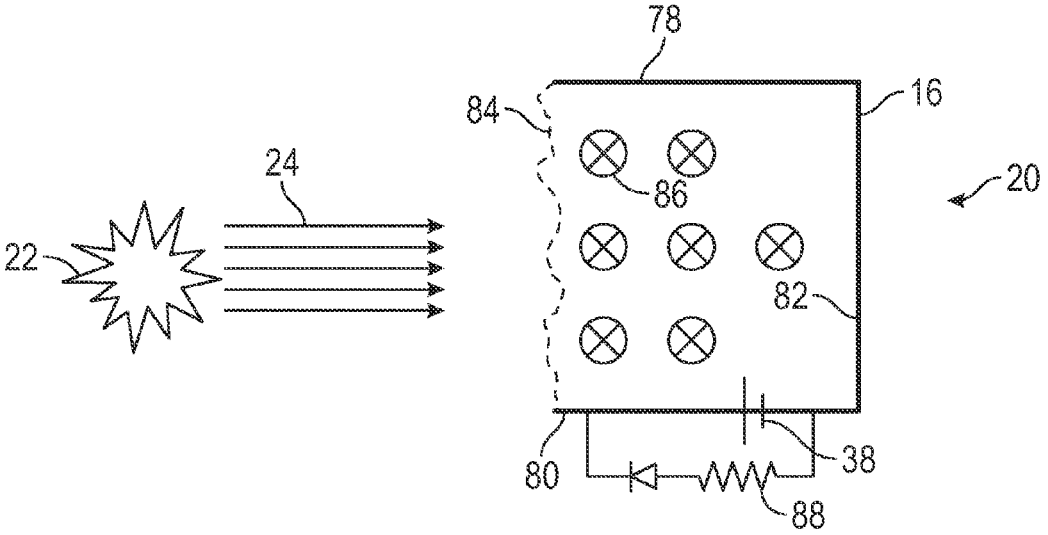
FIGS. 9A and 9B are schematic views of an embodiment of the arc generator of the disclosed system configured to generate an arc using relatively rigid electrodes.
Figure 9B:
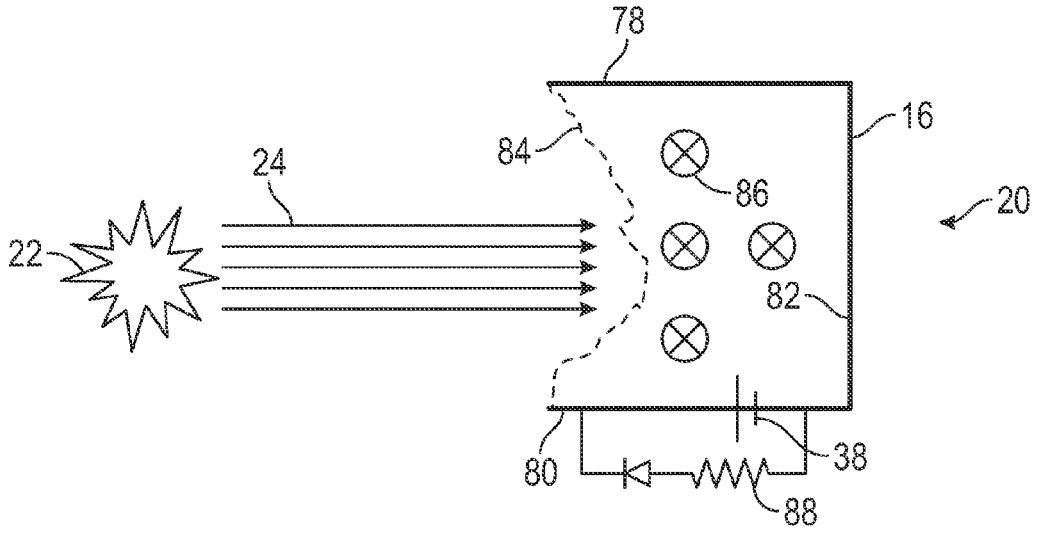

In the embodiment shown in FIGS. 9A and 9B, the arc generator 16 may be configured to have rigid electrodes 78, 80 joined by a rear wall 82 to form three sides of a box. An arc 84 may be formed by the power supply 38 of the arc generator 16 between electrodes 78, 80. When the arc 84 is contacted by the shockwave 24, the magnetic flux (represented by the crossed circles 86) is deflected inward but movement is constrained by the electrodes 78, 80 and wall 82. Instead, the flux 86 is compressed and increases the electric current in the electrodes 78, 80. In one embodiment, the power supply 16 is configured so that this additional electric current bypasses the power supply and instead is directed to a resistive load 88. Resistive load 88 also may take the form of a capacitor, which may receive a charge from the additional electric current. Thus, with the embodiments of FIGS. 8 and 9, magnetic induction is used to remove energy from the advancing shockwave by the additional mechanism of converting the shockwave energy to mechanical energy or converting the shockwave energy to current.

A system 10 may be comprised of multiple copies of each embodiment. In an embodiment, a system 10 may include a single sensor 12 connected to and controlling multiple, discrete arc generators 16, each mounted on the protected asset 18. In some applications, an embodiment may produce a relatively narrow, substantially linear arc of hot, ionized air. Multiple copies of each embodiment may be used to increase the frontal area as desired. Alternatively, a single copy of an embodiment may be used multiple times in rapid succession, producing multiple arcs that collectively cover the desired protected region 20. Further, these embodiments may be combined. For example, a system 10 may utilize ionizing tracer pellets to protect an asset 18 from explosions 22 relatively far away, and employ sacrificial conductors to protect the same asset from explosions at short range.

Figure 10:
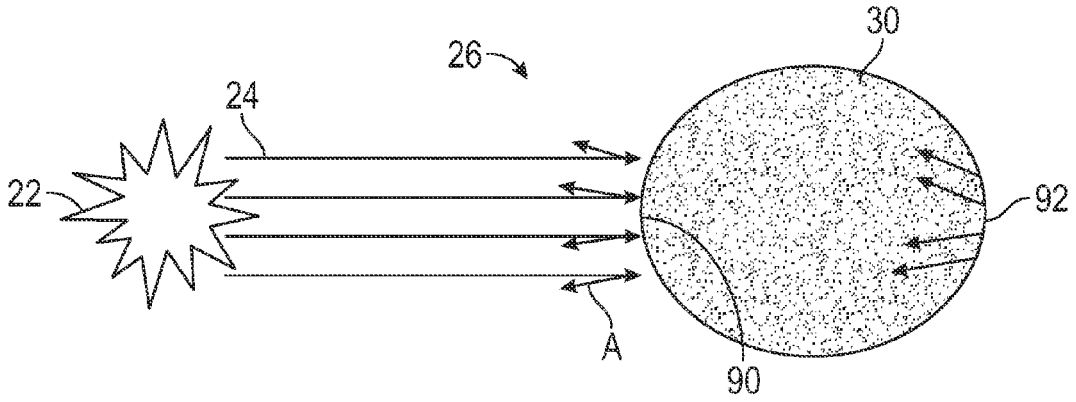
FIGS. 10 and 11 are diagrams showing some of the effects of a shockwave impacting the second, fluid medium.

With each of the embodiments discussed, the system 10 is deployed to attenuate the energy of an advancing shockwave 24 form an explosion 22 by creating a second fluid medium 30 that differs from the first fluid medium 26, which may be ambient air, positioned so that it interacts with the shockwave. As shown in FIG. 10, as the shockwave contacts the interface 90 between the first fluid medium 26 and the second fluid medium 30, the difference in refractive index reflects a fraction of the incoming energy toward the explosion 22, as indicated by arrows A. This partial reflection occurs a second time as the shockwave passes through the second fluid medium 30 and contacts the interface 92 between the second medium and the ambient 26 as it exits the second medium. All gradients or discontinuities in the medium provide a reflection point for the incoming shockwave 24. For example, if the second medium 30 is non-uniform, reflection will occur at each of many places within the medium.

Figure 11:
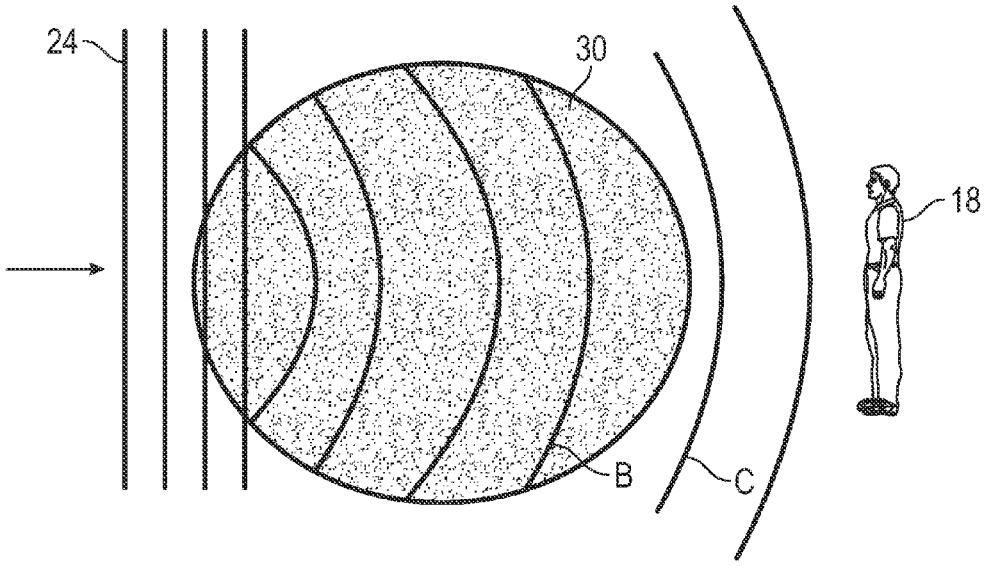

As shown in FIG. 11, shockwaves 24 obey Fermat's theory of least time and therefore an effective refractive index for the shockwave can be defined that is inversely proportional to the shock speed. The properties or composition of the second medium 30 are chosen such that the effective refractive index of the second medium 30 differs from the first medium 26 in at least one of temperature, molecular weight and composition. As the shockwave passes into or out of the second medium 30, the difference in effective refractive index refracts the wave, as shown by lines B, diverting it and defocusing it away from the protected asset 18. In the disclosed embodiments, the second medium 30 is created such that the shockwave travels faster in the second medium 30 than in the first medium 26, so the refractive index of the second medium is less than that of the first medium. Further, the second medium is created to have a convex shape and therefore acts as a divergent lens, so that the energy of the shockwave 24 spreads out, as shown by lines C, so its intensity drops as it approaches the protected asset 18.

In addition, the second medium 30 may absorb some shock energy as the shock travels through it. Factors contributing to the absorption of energy include energy retained in the molecules of the second medium itself (e.g., enhanced rotational energy, excited molecular bonds, excited electrons, molecular decomposition, and ionization) and shock energy converted to electromagnetic energy through blackbody emission from hot particles or photon emission from de-exciting various excited states.

A further mechanism for attenuating the energy density of the shockwave 24 is momentum exchange. If the second medium 30 is moving relative to the first medium 26, then it will exchange momentum with the shockwave 24. The result is a combination of reflection, slowing, and redirection of the shockwave. Any or all of the foregoing mechanisms may operate in a given embodiment. The composition, temperature, speed and location of the second medium 30 may be chosen or created to create any one or all of the aforementioned mechanisms.

While the method and forms of apparatus disclosed herein constitute preferred aspects of the disclosed shockwave attenuation apparatus and method, other methods and forms of apparatus may be employed without departing from the scope of the invention.

What is claimed is:

1. A shockwave attenuation system, comprising:

a sensor for generating a detection signal based on at least one of detecting an explosion capable of producing a shockwave traveling through a first fluid medium to a protected region, and estimating a location and time of the explosion, and detecting an explosive device and estimating a location and time of an explosion from the explosive device that is capable of producing the shockwave traveling through the first fluid medium; and an arc generator in communication with the sensor for receiving the detection signal therefrom, and in response thereto heat a selected region of the first fluid medium rapidly to create a second, transient medium, different from the first medium, interposed between the shockwave and the protected region such that the shockwave contacts the second, transient medium and is attenuated in energy density before it reaches a protected asset in the protected region.

2. The system of claim 1, wherein the second medium differs from the first medium in at least one of temperature, density and composition.

3. The system of claim 1, wherein the arc generator heats the region of the first fluid medium to create the second medium by using one of an electric arc, a laser-induced arc and a microwave-induced arc.

4. The system of claim 1, wherein the arc generator includes a power supply, and the arc generator rapidly creates the second medium by creating an electrically conductive path from the power supply to the selected region and back to the power supply.

5. The system of claim 4, wherein the arc generator creates the electrically conductive path utilizing at least one of high intensity laser pulses to form a laser-induced plasma channel (LIPC), pellets that leave a conductive trail of ions, sacrificial conductors, projectiles trailing electrical wires fired along converging paths, magnetic induction utilizing flexible channels of ionized air, and magnetic induction utilizing substantially rigid conductors.

6. The system of claim 1, wherein the protected region includes at least one protected asset, and at least one of the sensor and the arc generator is mounted on the protected asset.

7. The system of claim 1, wherein the sensor detects at least two bands of electromagnetic radiation generated by the explosion.

8. The system of claim 1, wherein the sensor detects at least one of a shape, trajectory and speed of an incoming threat containing the explosive device, and to calculate a signature of the incoming threat, the sensor also using the signature to determine likely explosion characteristics of the explosive device.

9. The system of claim 8, wherein the explosion characteristics include at least one of a location of the explosion, a time of the explosion, and a magnitude of the explosion.

10. The system of claim 9, wherein the sensor uses the explosion characteristics to calculate a location of the selected region.

11. The system of claim 6, wherein the protected asset is one of a surface vessel, a submarine vessel, an offshore platform, a land vehicle, a land structure, and a human, and wherein the sensor determines the selected region based on one or more predetermined vulnerabilities of the protected asset.

12. The system of claim 1, further comprising multiple arc generators, each connected to the sensor.

13. The system of claim 12, wherein the multiple arc generators are adapted to be mounted on a protected asset.

14. The system of claim 1, wherein the first fluid medium is ambient air, and the arc generator utilizes at least one of electric, microwave and laser energy to produce at least one of relatively hot and ionized air to form the second, transient medium in the selected region, such that the shockwave contacts the second, transient medium and is attenuated in energy density by at least one of reflection, refraction, absorption, momentum transfer and magnetic induction.

15. A method of attenuating a shockwave, the method comprising:

detecting with a sensor at least one of an explosion capable of producing a shockwave traveling through a first fluid medium to a protected region, and an explosive device:

estimating a location and time of the explosion of the at least one of an explosion from the explosive device and the explosive device that is capable of producing the shockwave;

generating a detection signal by the sensor in response to detecting at least one of the explosion and the explosive device;

heating a selected region of the first fluid medium rapidly to create a second, transient medium, different from the first medium, by an arc generator in communication with the sensor, in response to the detection signal, the second medium being interposed between the shockwave and the protected region such that the shockwave contacts the second, transient medium and is attenuated in energy density before it reaches the protected region.

16. The method of claim 15, wherein the second, transient medium attenuates the energy density of the shockwave by at least one of reflection, refraction, absorption, momentum transfer and magnetic induction.

17. The method of claim 15, wherein detecting includes detecting, with one or more sensors, at least two bands of electromagnetic radiation from the explosion.

18. The method of claim 15, wherein heating includes rapidly creating the second medium by creating an electrically conductive path from a power supply to the selected region and back to the power supply.

19. The method of claim 18, wherein creating an electrically conductive path utilizes at least one of high intensity laser pulses to form a laser-induced plasma channel (LIPC), pellets that leave a conductive trail of ions, sacrificial conductors, projectiles trailing electrical wires fired along converging paths, magnetic induction utilizing flexible channels of ionized air, and magnetic induction utilizing substantially rigid channels of ionized air.

20. A method of attenuating a shockwave, the method comprising:

detecting with a sensor at least one of an explosive device and an explosion from the explosive device;

estimating a location and time of the explosion of the at least one of an explosion from the explosive device and the explosive device and predicting an explosion therefrom that is capable of producing the shockwave;

calculating with a computer a firing plan based upon at least one of data and models of vulnerability of a protected asset, and at least one of data and models of effectiveness of actuating an arc generator to heat a selected region adjacent the protected region; and if the firing plan determines that it is cost effective to execute the firing plan in view of a cost to operate an arc generator and probable cost of damage from a shockwave from the explosion, actuating the arc generator to heat a selected region of a first fluid medium rapidly to create a second, transient medium, different from the first medium, the second medium being interposed between the shockwave and the protected region such that the shockwave contacts the second, transient medium and is attenuated in energy density before it reaches the protected asset.

21. The method of claim 20, wherein detecting includes measuring a signature of an incoming threat carrying the explosive device;

comparing the signature with known signatures of a plurality of different threats;

determining a probability the incoming threat is one of the plurality of different threats; and calculating includes estimating a probability distribution function of explosion magnitudes and locations relative to the protected asset based on at least one of stored data about the type of explosive device, measured motion of the incoming threat, and a shape, relative orientation and relative motion of the protected asset; and making a determination to counter the incoming threat or not counter the incoming threat, based on one of stored data and models of vulnerability of the protected asset to shockwaves, and data from at least one of data and models of performance of the arc generator with respect to attenuating shockwaves from the estimated explosion magnitudes and locations.

22. The method of claim 20, wherein detecting includes measuring a signature of the explosion from the explosive device;

comparing the signature with stored signatures of a plurality of known different explosive devices;

determining a probability the explosion is from one of the plurality of known different explosive devices; and calculating includes estimating a probability distribution function of explosion magnitudes and locations relative to the protected asset based on at least one of stored data about the type of explosion, the location of the explosion and the shape, relative orientation and relative motion of the protected asset; and making a determination to counter the explosion or not counter the explosion, based on one of stored data and models of vulnerability of the protected asset to shockwaves from the explosion, and data from at least one of data and models of performance of the arc generator with respect to attenuating shockwaves from at least one of an estimated explosion magnitude and location.

23. The method of claim 20, wherein calculating includes calculating with a computer a firing plan based upon at least one of data and models of vulnerability of the protected asset within a protected region.

* * * * *